United States Patent [19]

Yamaguchi

[11] Patent Number: 5,031,273

[45] Date of Patent: Jul. 16, 1991

[54] VIBRATION-FREE HANDLE

[75] Inventor: Yasuharu Yamaguchi, Yokohama, Japan

[73] Assignee: Kyowa Metal Works Co., Ltd., Kanagawa, Japan

[21] Appl. No.: 358,997

[22] Filed: May 26, 1989

[30] Foreign Application Priority Data

May 27, 1988 [JP] Japan ..... 63-128495

[51] Int. Cl.[5] ..... B25G 1/00

[52] U.S. Cl. ..... 16/116 R; 173/162.2

[58] Field of Search ..... 16/116 R, 111 R, DIG. 41; 173/162.2

[56] References Cited

U.S. PATENT DOCUMENTS

| | | | |
|---|---|---|---|
| 2,035,643 | 3/1936 | Douglass et al. | 173/162.2 |
| 4,648,468 | 3/1987 | Honsa | 173/162.2 |
| 4,771,833 | 9/1988 | Honsa | 173/162.2 |
| 4,819,742 | 4/1989 | Driggers | 173/162.2 |

FOREIGN PATENT DOCUMENTS

| | | | |
|---|---|---|---|
| 2080919 | 2/1982 | United Kingdom | 173/162.2 |
| 2138348 | 10/1984 | United Kingdom | 173/162.2 |

*Primary Examiner*—Kurt Rowan
*Assistant Examiner*—James Minen
*Attorney, Agent, or Firm*—Dykema Gossett

[57] ABSTRACT

The vibration-free handle comprises a first rod connected to a vibration source via an attachment, a second rod connected to the first rod at one end thereof with a predetermined inclination, a mass body mounted on the other end of the second rod, and an elastic member provided between the first rod and the vibration source for covering the first and second rods. The elastic member possesses spring constants in three directions, one direction being defined by the direction the vibration source vibrates (z-direction) and the other two directions extending perpendicularly to each other in a plane perpendicular to the z-direction. When the second rod, which serves as a grip of the handle, extends perpendicularly to the z-direction and the vibration source starts vibrating, there appear "vibration knots" in the second rod, at which the vibration amplitude is substantially zero, in three directions. The "vibration knots" reduce the vibration from the vibration source. The amounts of vibration reduction in three directions are respectively adjusted by the inclination between the first rod and the second rod.

16 Claims, 10 Drawing Sheets

VIBRATION-FREE HANDLE

BACKGROUND OF THE INVENTION

1. Technical Field

The present invention relates to a vibration-free handle adapted for use on a vibrant tool such as a jack-hammer or a pneumatic drill, and particularly to a vibration-free handle which is provided with a novel vibration isolator.

2. Background Art

In using a hand-operated vibration tool such as a jack-hammer or a chain saw, it has been a serious problem to damp vibrations from the tool since vibrations of certain frequency, generally between 60 and 100 Hz, are harmful to tool operators. One widely known device for damping vibrations from a tool is a rubber cushion, which is disposed between the vibrant tool and a handle mounted thereon. Another is a vibration preventive device which includes springs. In these devices, vibration isolation is achieved by lowering the natural vibration frequency of the handle to a value less than the exciting frequency of the tool. Therefore, the weight of the handle has to be raised in order to reduce the vibration, if satisfactory vibration isolation is desired, or the elastic coefficient of the rubber cushion or the springs has to be lowered. However, in the former case, the total weight of the tool increases, and in the latter case, handling of the tool becomes difficult since the connection between the tool and the handle becomes too soft.

Also, from another point of view, conventional vibration isolators have been insufficient. The vibration consists of three-dimensional elements of vibrations. Here, the direction the tool vibrates is called a "z-direction'-'—this direction is considered a "vertical direction" in this specification—and two directions perpendicular to the z-direction are respectively called a "x-direction" and a "y-direction"—these two directions are considered extending horizontally and the y-direction represents the direction the handle grip extends. The conventional vibration isolators are only satisfactory in absorbing the vibration elements in z- and x-directions.

SUMMARY OF THE INVENTION

The vibration-free handle of the present invention is a handle equipped with an improved vibration isolator.

One object of the present invention is to provide a vibration-free handle whose weight is not increased by the vibration isolator while not making the vibrant tool too soft.

Another object of the present invention is to provide a vibration-free handle which can absorb all three elements of vibration.

To this end, the vibration-free handle comprises a first rod to be connected to a vibration source, a second rod connected to the first rod at a predetermined angle $\alpha$, a mass body mounted on the extending end of the second rod, and an elastic member having predetermined spring constants respectively in x-, y- and z-directions provided between the first rod and the vibration source. The second rod preferably extends perpendicularly to the z-direction or the vibration direction of the vibration source. The elastic member may be a rubber cushion that partially encloses the first rod. The rubber cushion is preferably polygonal in shape in cross-section. Such a polygonal rubber cushion effectively absorbs the vibration of the first rod. As a tool provided with the vibration-free handle starts vibrating, vibration "knots" appear at which the vibration amplitudes are zero, in the second rod. The tool operator is substantially insulated from the vibration source due to these vibration knots. The degree of vibration isolation in three directions is respectively adjusted by changing the angle $\alpha$. The vibration-free handle of the present invention can be of lightweight construction compared with conventional ones. Also, the connection of the handle with the vibrant tool is not deteriorated since there are no unduly soft elements between the handle and the tool.

DESCRIPTION OF THE PREFERRED EMBODIMENTS

Now, preferred embodiments of the present invention will be explained with reference to the accompanying drawings.

First, the fundamental idea and theory of the present invention will be explained using a vibration-free handle which insulates the vibration elements in z- and x-directions.

Figure 11:
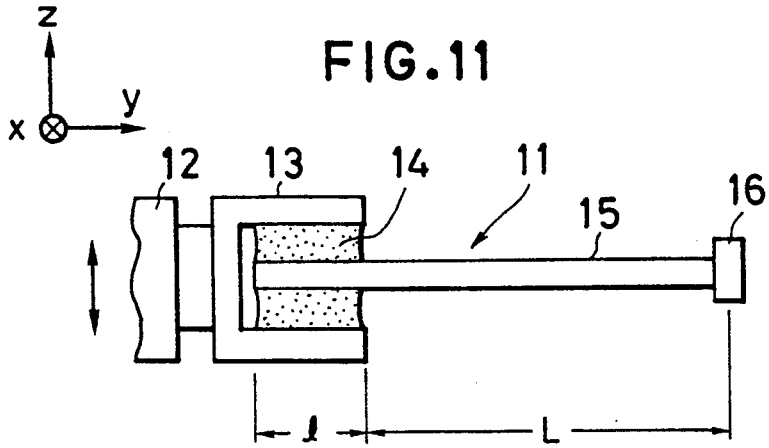
FIG. 11 schematically illustrates a vibration-free handle which is capable of insulating the vibration elements in two directions.

Referring to FIG. 11, a vibration-free handle 11 is mounted on a vibration source 12 via a connecting element 13. The connecting element 13 is a cylindrical member having a bottom. A rod 15 extends in the y-direction to form the connecting element 13 with an elastic member 14 being interposed between the connecting element 13 and the rod 15 at its root. A mass body 16 is mounted on the extending end of the rod 15. The rod 15 is partially enclosed by the elastic member 14, namely by a length of l, and accordingly it protrudes from the elastic member 14 by a length of L.

Figure 13:
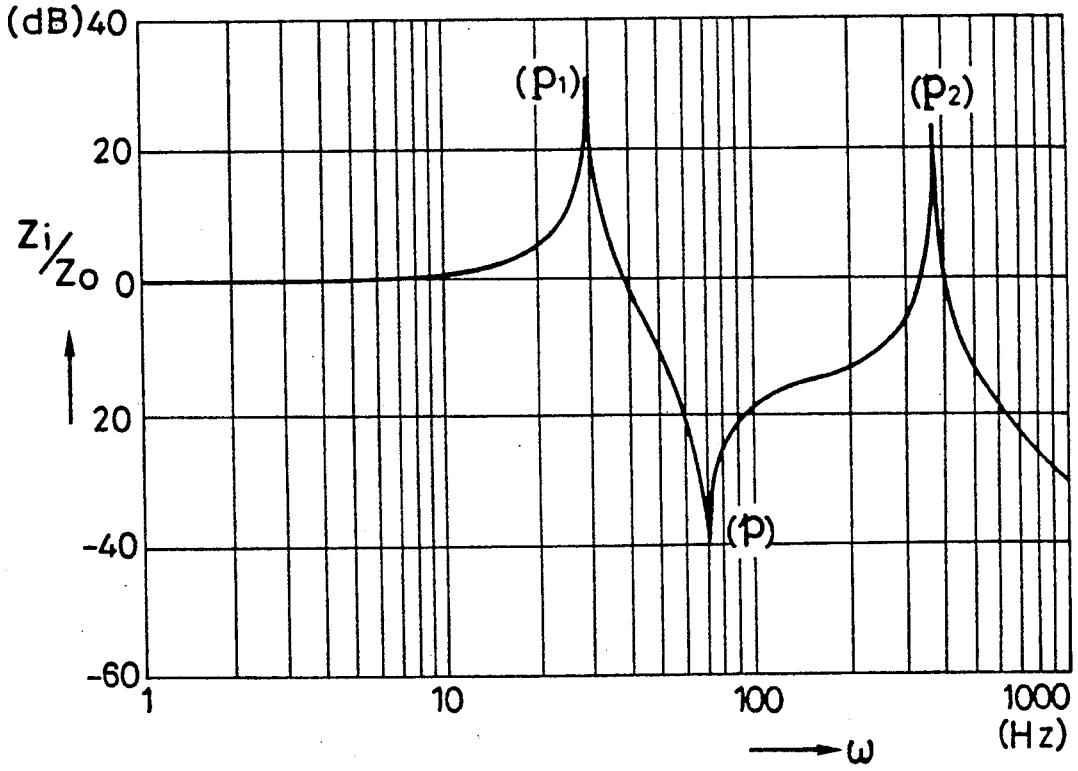
FIG. 13 is a graph of vibration-response of FIG. 11.

Referring to FIG. 13, which is an output by a computer simulation, shown is a graph of how the rod vibrates in z-direction when the vibration source 12 vibrates in z-direction. The vertical axis of the graph indicates a ratio of zi and zo (amplitude ratio), and the horizontal axis thereof indicates $\omega$, where zi represents a movement of the connecting element 13 in z-direction, zo represents that of the rod 15 at a particular point thereof, and $\omega$ represents an exciting frequency of the vibration source. As seen in FIG. 13, there are two resonance peaks P1 and P2 at 30 Hz and 400 Hz respectively. Also seen is a reverse resonance point p between two peaks P1 and P2. This means that there are exciting frequencies at which the amplitude ratio is zero. In other words, there appear the aforementioned "vibration knots" of stationary vibration between P1 and P2. In designing the vibration-free handle, it is determined by experimentation how and where the "vibration knots" appear in a vibration frequency range between 60 and 100 Hz, which frequency range is generally considered as a harmful frequency range to the operator. In other words, the handle is designed in a manner such that a tool operator grips the "knots" so that the harmful vibration is not transmitted to the operator.

Figure 12:
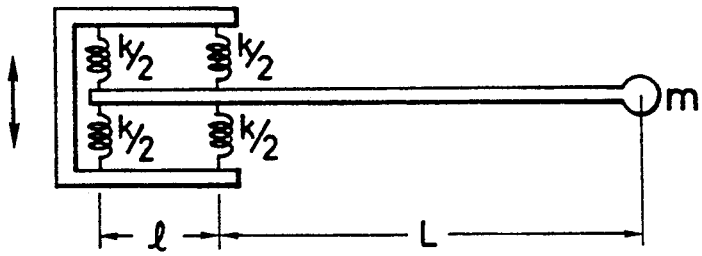
FIG. 12 is a model of FIG. 11.

Two resonance peaks P1 and P2 mean that there are two natural frequencies. Suppose the elastic member 14 is equivalently replaced by springs whose spring constant is k/2 respectively; the natural frequency is given by the following equations:

$$\omega Z = \sqrt{\frac{k}{m}}$$

$$\omega\theta = \sqrt{\frac{k}{m} \cdot \frac{l^2}{2L^2}} \qquad (2)$$

where $\omega\theta$ is a natural frequency of the rod 15 due to its pitching movement around z-axis, and $\omega Z$ is another natural frequency of the rod 15 due to its vibrating movement in the z-axis. Therefore, it is possible to produce "vibration knots" at an arbitrary position by properly determining the buried length l of the rod 15, the protruding length L of the rod 15, and the mass of the weight 16. If the model of FIG. 12 is taken as a top view of FIG. 11, the same conclusion can be applied to the vibration in an x-axis. Specifically, since the elastic member 14 extends horizontally, the harmful vibration in the x-axis (pitching movement) can be also reduced.

Figure 1:
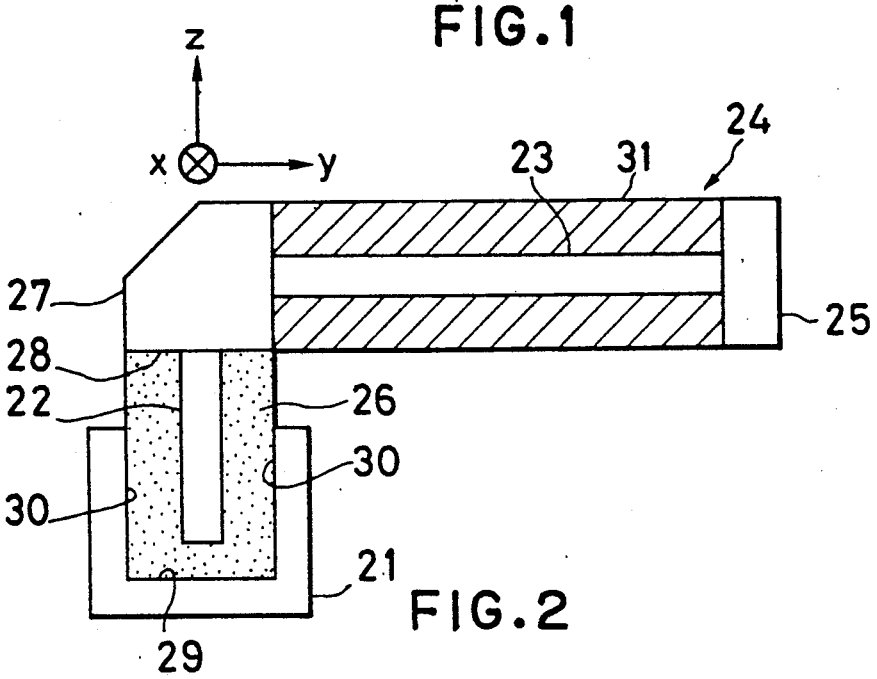
FIG. 1 is a longitudinal section view of a vibration-free handle according to one embodiment of the present invention.

Now an embodiment of the present invention will be explained. Referring to FIG. 1, the vibration-free handle comprises a U-shaped connecting element 21 mounted on the vibration source (not shown), a first rod 22 which extends in z-direction (direction the vibration source vibrates) from the connecting element 21, a second rod 23 which extends in y-direction (horizontal direction) from the first rod 22 via an intermediate member 27, a weight 25 attached to the extending end 24 of the second rod 23, and an elastic member 26 fitted in the connecting element 21 while enclosing and supporting the first rod 22. The second rod 23 is connected to the first rod 22 by the joint member 27 at 90 degrees. The elastic member 26 is made of a rubber cushion. The elastic member 26 extends between the lower face 28 of the joint member 27 and the bottom 29 of the connecting member 21 in its height direction (z-direction), and the same extends between the side wall 30 of the connecting member 21 in its transverse direction (x- and y-directions). The second rod 23 is enclosed by another rubber cushion 31 such that it serves as a grip of the handle. The second rod 23 extends between the joint member 27 and the weight 25 in the y-direction.

Figure 2:
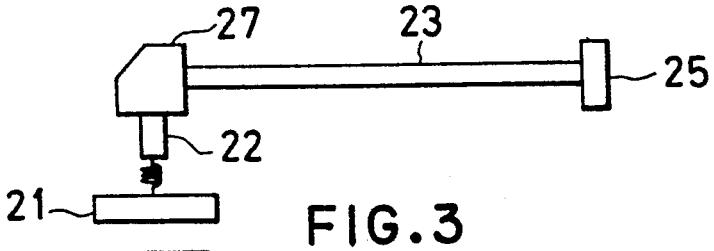
FIG. 2 is a model showing a spring force in z-direction of FIG. 1.
Figure 3:
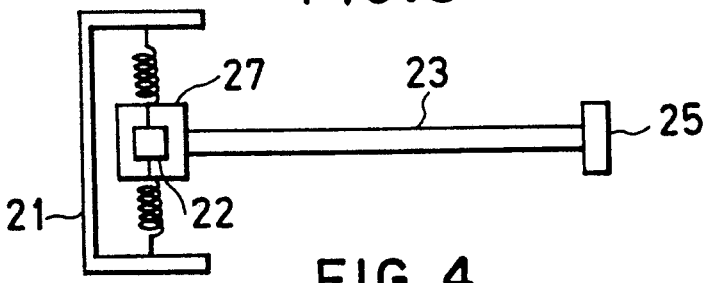
FIG. 3 is another model showing a spring force in x-direction of FIG. 1.
Figure 4:
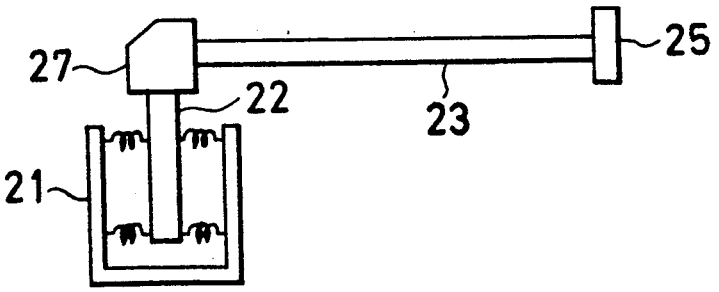
FIG. 4 is still another model showing a spring force in y-direction of FIG. 1.
Figure 5:
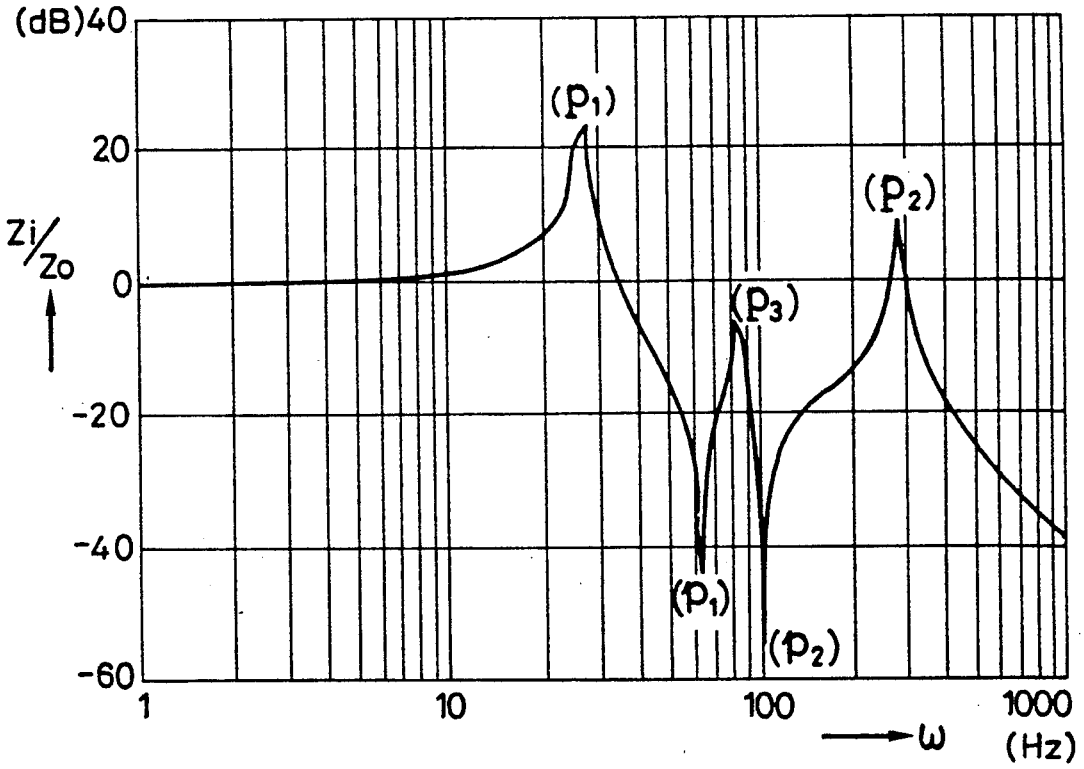
FIG. 5 is a graph showing vibration-response of the handle of FIG. 1.

FIGS. 2, 3 and 4 show models of the elastic member as it is equivalently replaced by springs in the z-, x- and y-directions respectively. A computer-simulated vibration of the handle of FIG. 1 is depicted in FIG. 5. In the graph, there are three resonance peaks P1, P2 and P3, or there is one more peak P3 in addition to P1 and P2 of FIG. 13, and two reverse resonance points p1 and p2. This means that there appears a natural frequency in the y-direction in addition to z- and x-directions. It is assumed that the third resonance occurs due to a transmission of the moment from the first rod 22. Therefore, further "vibration knots" are created in the second rod 23 due to spring forces of FIG. 4 (y-direction), in addition to the aforementioned "knots" of FIG. 11. The new "knots" substantially insulate vibration in the y-direction. Accordingly, all three elements of vibration (vibration elements in x-, y- and z-directions) can be reduced to a desired level by properly determining the length of the first rod 22, the length of the second rod 23, the mass of the weight 25, and characteristics (spring constant) of the rubber cushion.

Figure 6:
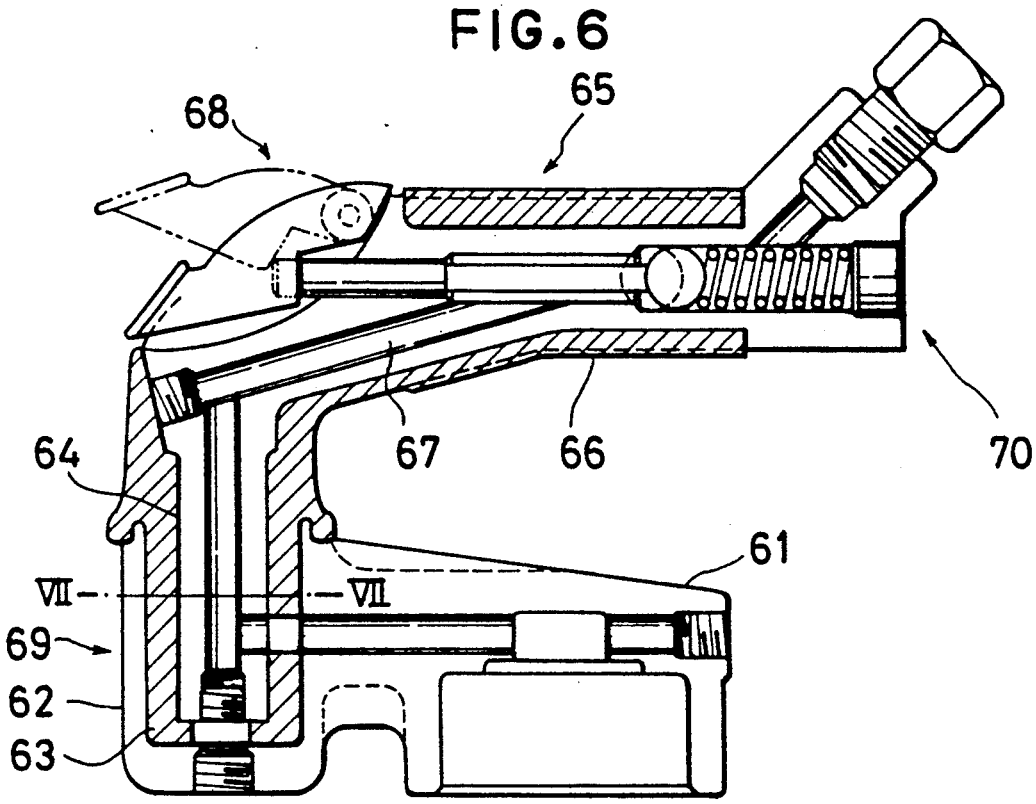
FIG. 6 is a sectional view of another vibration-free handle according to the present invention.
Figure 7:
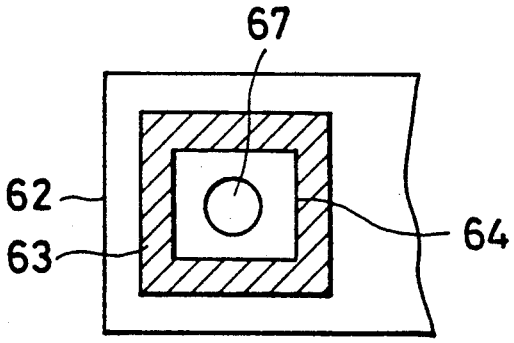
FIG. 7 is a view taken along the line VII—VII of FIG. 6.

The vibration-free handle of the present invention may be mounted on a pneumatic pitching hammer as illustrated in FIG. 6. A mounting member 62 is formed as a part of an attachment 61 to a hammer's body (not shown). The first rod 64 is disposed in the mounting member 62. The rubber cushion (first elastic member) 63 entirely encloses the first rod 64. The second rod 65 lies in the y-direction and serves as a grip of the handle, and it is partially enclosed by another elastic member 66, which is contiguous to the first elastic member 63. Therefore, both the first and second rods are enclosed by a substantially single elastic member in this embodiment. An extension 70 from the second rod 65 serves as a weight. An air passage 67 is bored along the first rod 64, and switch means 68 for opening/closing the passage 67 is provided at a corner of the handle. Referring to FIG. 7, the first rod 64 is square in cross-section, at least in its lower half 69, and is fitted in the mounting member 62. Therefore, the pitching movement of the first rod 64 around the z-axis is restricted due to the four corners of the first rod 64 and corresponding four corners of the first rubber cushion 63. Also, proper connecting hardness between the handle and the hammer body is ensured. Since clearances between the first rod 64 and the cushion rubber 63 in the x- and y-directions are easily adjustable by changing the thickness of the elements 63 and/or 64, the spring constants and the connecting hardness are easy to adjust.

Figure 8:
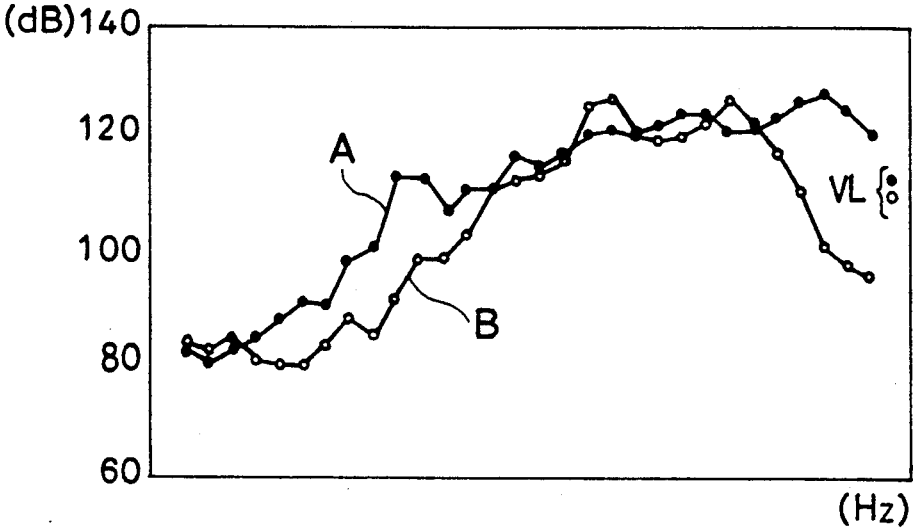
FIGS. 8 to 10 are graphs showing vibration-response of a handle of FIG. 6 in x-, y-, and z-directions respectively.
Figure 9:
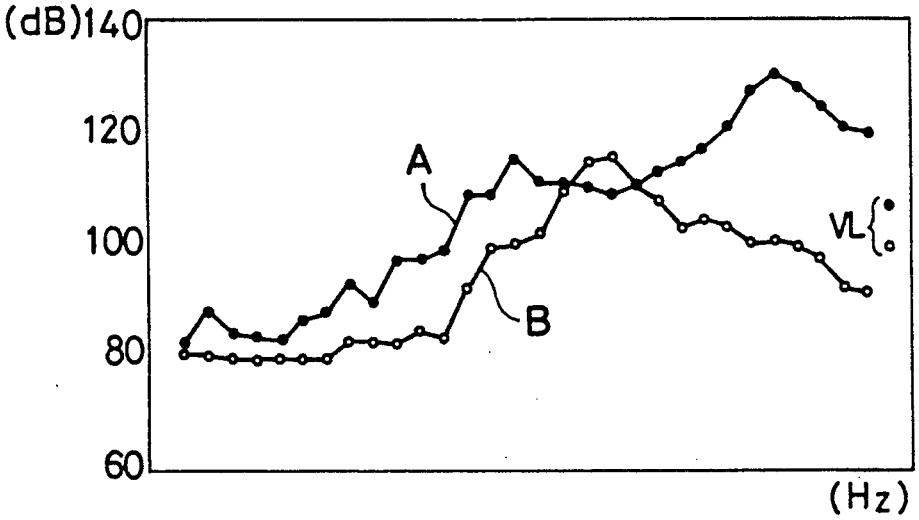
Figure 10:
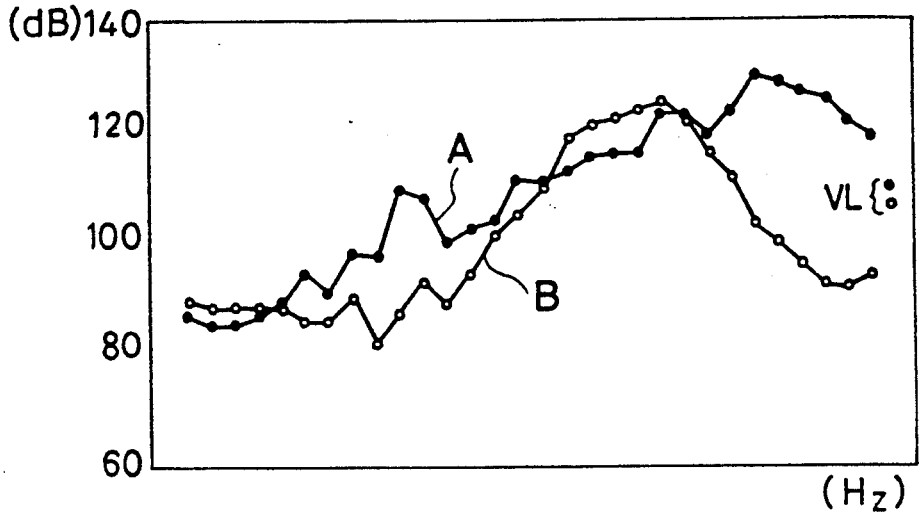

The results of an experiment by the inventors will be now described with reference to Table 1 and FIGS. 8 (x-direction), 9 (y-direction) and 10 (z-direction). The experiment was conducted using the measure "Vibration Level (VL) of Hand-Operated Tool," by the Labor Ministry of Japan (Circular Jan. 8, 1988). "Vibration Level (VL)" was measured at the center of gravity of the second rod 65. The same experiment was also conducted on a conventional handle, and data (A) therefrom are shown in also Table 1 and FIGS. 8 to 10. The data (B) represents the present invention. As appreciated from the graphs, there is a considerable difference between the (A) and (B) in VL in all directions x, y and z. This means that less vibrations occur respectively in three directions in the handle of the present invention.

TABLE 1

| VIBRATION DIRECTION | X-DIRECTION | Y-DIRECTION | Z-DIRECTION |
|---|---|---|---|
| PRIOR ART (A) | 106.8 | 110.2 | 114.5 |
| PRESENT INVENTION (B) | 97.3 | 108.0 | 110.9 |
| | | | VL(dB) |

Figure 14:
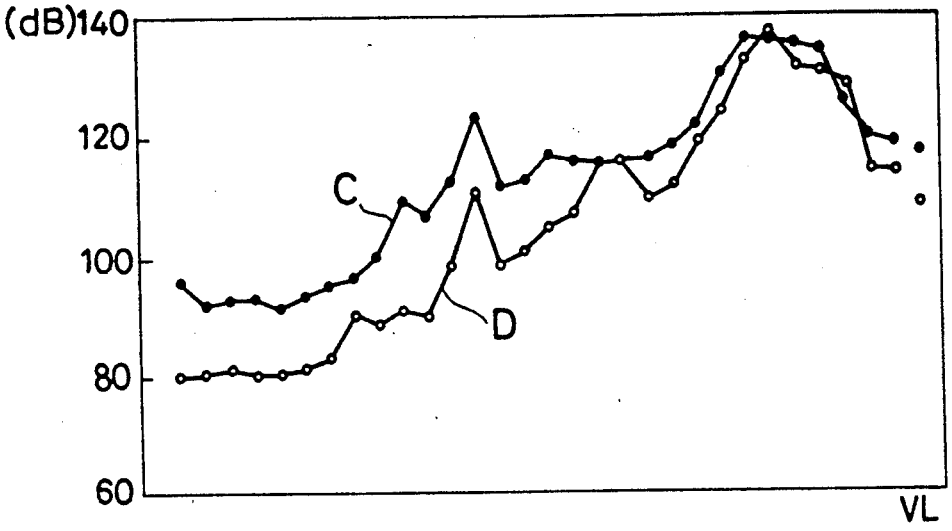
FIGS. 14 to 16 are graphs of vibration-response in x-, y- and z-directions respectively as the vibration-free handle is mounted on an electrical hammer.
Figure 15:
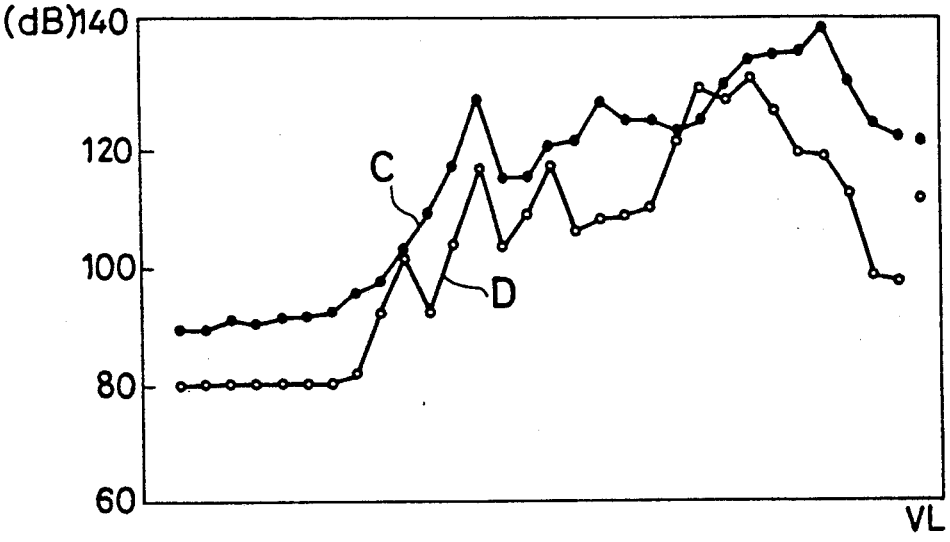
Figure 16:
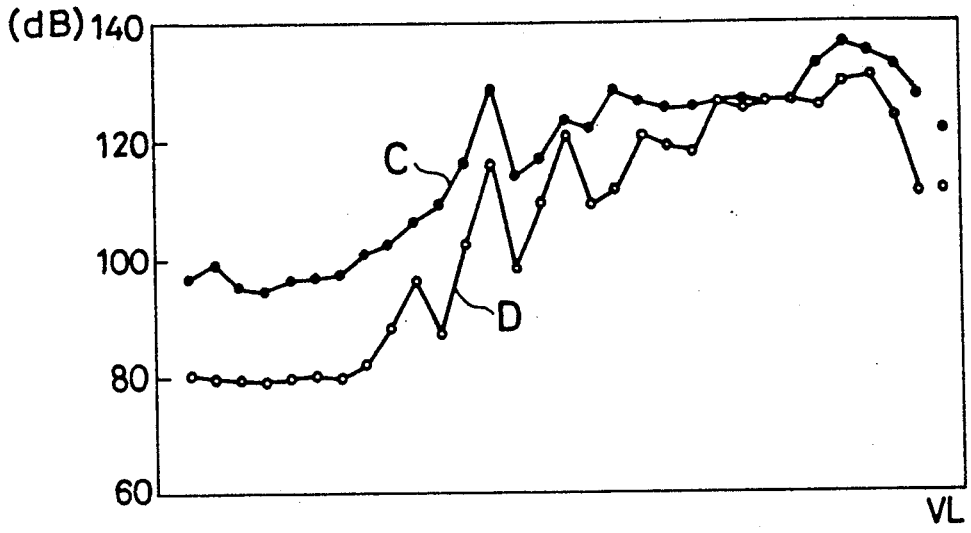
Figure 17:
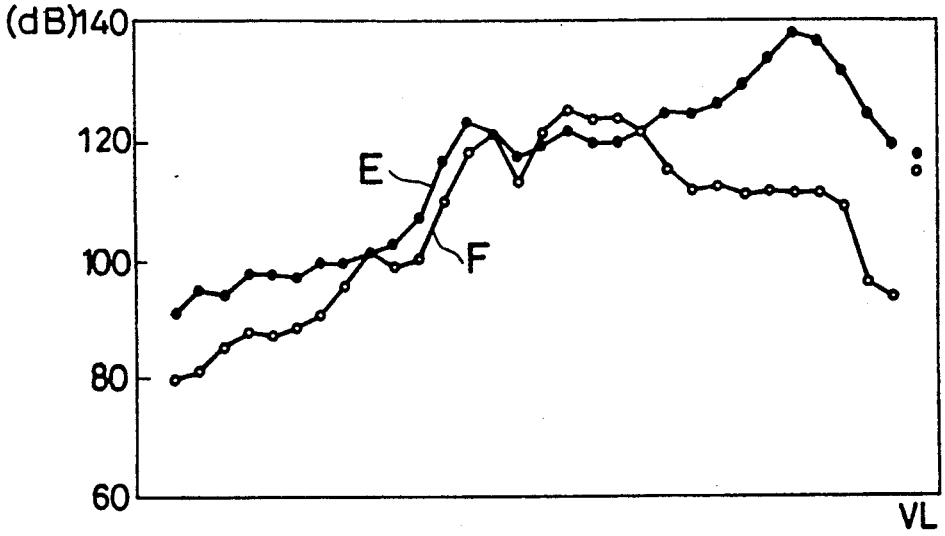
FIGS. 17 to 19 are graphs of vibration-response in x-, y- and z-directions respectively as the vibration-free handle is mounted on a small jack-hammer.
Figure 18:
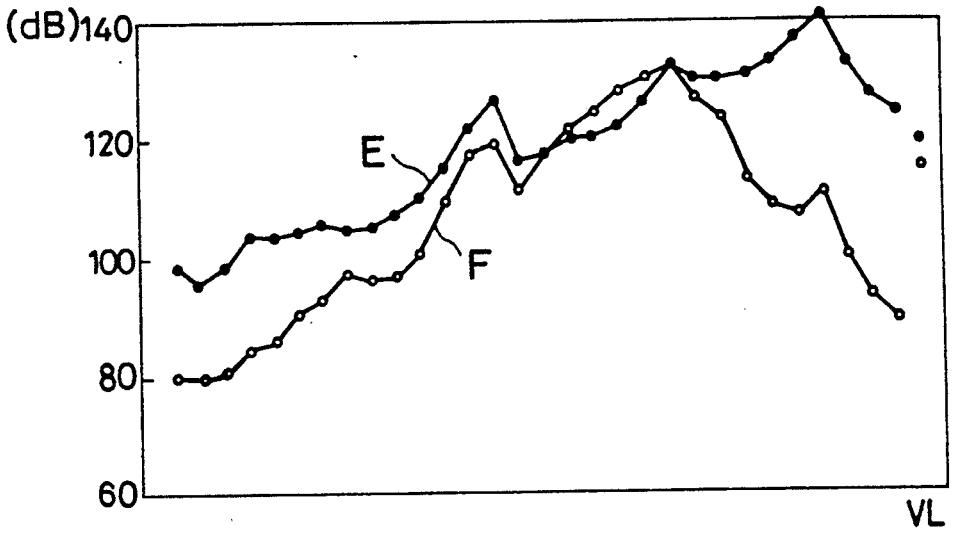
Figure 19:
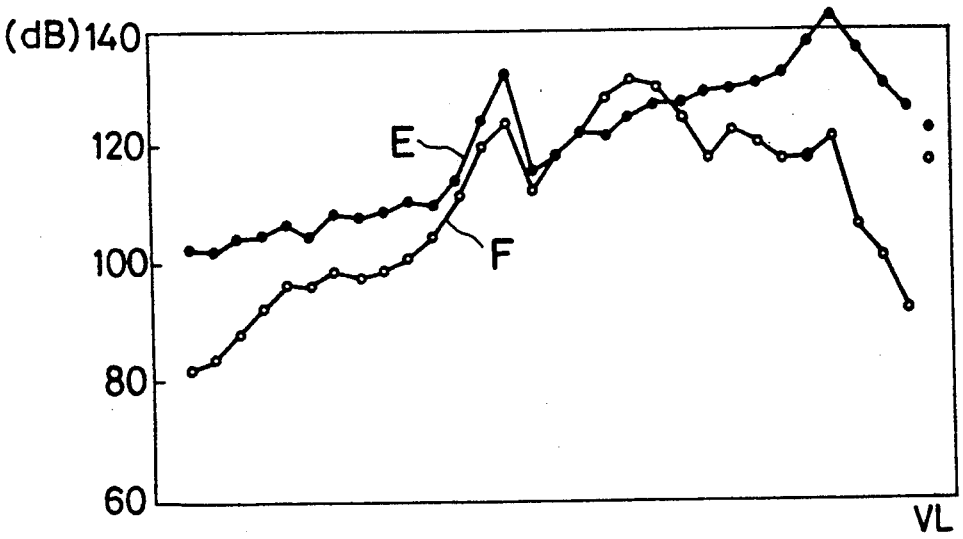

It should be noted that the vibration-free handle of the present invention may be attached to a chain saw, a grinder, an electric hammer or the like. Results of such applications are shown in FIGS. 14 to 16 and Table 2 (electrical hammer) and FIGS. 17 to 19 and Table 3 (jack-hammer).

TABLE 2

| VIBRATION DIRECTION | X-DIRECTION | Y-DIRECTION | Z-DIRECTION |
|---|---|---|---|
| PRIOR ART (C) | 116.0 | 120.4 | 121.1 |
| PRESENT INVENTION (D) | 107.5 | 110.2 | 110.9 |
| | | | VL(dB) |

TABLE 3

| VIBRATION DIRECTION | X-DIRECTION | Y-DIRECTION | Z-DIRECTION |
|---|---|---|---|
| PRIOR ART (E) | 117.6 | 119.8 | 122.5 |
| PRESENT INVENTION (F) | 114.8 | 115.6 | 117.4 |
| | | | VL(dB) |

Figure 20:
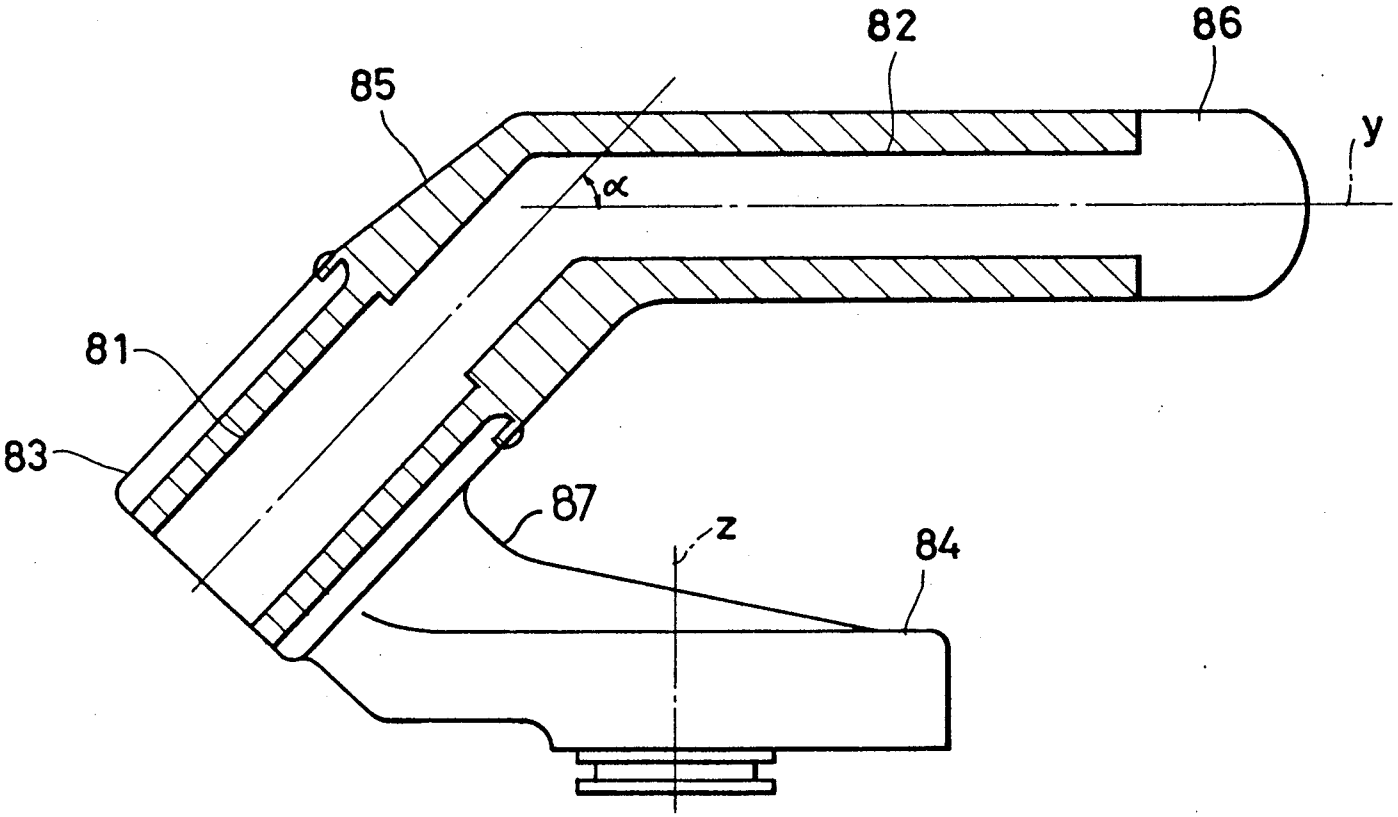
FIG. 20 illustrates yet another embodiment of the present invention.

Also, the first rod does not have to extend in the z-direction. For instance, the first rod may extend having an angle of 45 degrees with respect to z-axis, as shown in FIG. 20. The second rod 82 extends from the first rod 81 in the y-direction. Therefore, the angle $\alpha$ between the first rod 81 and the second rod 82 is 45 degrees. An extension 86 at the end of the second rod 82 serves as a mass body. A cushion rubber 86 covers the first and second rods. Numeral 84 designates a cover member of a vibrant tool of a type having a reciprocating piston thereinside (not shown). The head cover 84 has an extension member 87, at the end of which the first rod mounting member 83 is formed. The extension member 87 extends from the head cover 84 diagonally and upwardly. The first rod mounting member 83 is a cylindrical member 83. The elastic member 85 is fitted on the mounting member 83 and protrudes therefrom covering the second rod 82.

According to the vibration-free handle of this embodiment, the rubber cushion 85 has different spring constants in the y- and z-directions, compared with the foregoing embodiment, due to the inclination Specifically, the vibration element in the y-direction is increased while that in the z-direction is reduced.

The handle of FIG. 20 was also tested in the same way as the last-mentioned embodiment. Table 4 shows the result thereof. The vibration elements were measured with the inclination of 90°, 60° and 45°. "PRIOR ART I" employed a handle without any vibration isolator. "PRIOR ART II" employed a handle provided with a vibration isolator effective in the x- and z-directions. As appreciated from Table 4, the vibration isolation is deteriorated in the y-direction as the inclination $\alpha$ is decreased, and accordingly vibration isolations in the z-direction are improved. Therefore, a handle of arbitrary vibration characteristics can be designed by changing the inclination $\alpha$.

In the above embodiments, the second rod extends perpendicularly to the direction the vibration source vibrates. However, the second rod may extend diagonally.

Also, the first rod may be triangular or any other polygonal shape in cross-section, other than square as shown in FIG. 4, or the first rod may have an arbitrary shape in cross-section.

TABLE 4

| VIBRATION DIRECTION | X-DIRECTION | Y-DIRECTION | Z-DIRECTION |
|---|---|---|---|
| PRIOR ART (I) | 112.4 | 118.0 | 129.8 |
| PRIOR ART (II) | 109.0 | 119.0 | 115.5 |
| PRESENT INVENTION [$\alpha$ = 90°] | 109.1 | 112.4 | 119.8 |
| PRESENT INVENTION [$\alpha$ = 60°] | 108.7 | 114.3 | 118.0 |
| PRESENT INVENTION [$\alpha$ = 45°] | 109.0 | 117.2 | 116.8 |
| | | | VL(dB) |

What is claimed is:

1. A vibration-free handle adapted to be mounted on a vibration source such as a vibrant tool via an elastic member, comprising:

a first rod indirectly connected to the vibration source, the first rod having a free end defined as an end closest to said vibration source and another end; and a member connected to the vibration source and enclosing the free end of the first rod, the fee end being enclosed in three directions, one of said three directions being defined by the direction the vibration source vibrates and the other two of said three directions extending perpendicularly to each other in a plane perpendicular to said one direction said member having a portion between said free end and said vibration source and also enclosing the outer periphery of said first rod adjacent to said free end;

a second rod having one end thereof connected to said another end of the first rod and at a predetermined inclination relative to the first rod such that it is non-parallel to said first rod;

a mass body on the other end of the second rod; and an elastic member provided between the free end of the first rod and the member, the elastic member possessing spring constants in the three directions.

2. A vibration-free handle according to claim 1, wherein the second rod extends perpendicularly relative to the direction the vibration source vibrates.

3. A vibration-free handle according to claim 2, wherein the elastic member comprises a rubber cushion which encloses the first rod.

4. A vibration-free handle according to claim 3, further including another elastic member for enclosing the second rod.

5. A vibration-free handle according to claim 4, wherein the first rod is polygonal in cross-section.

6. A vibration-free handle according to claim 3, wherein the first rod is polygonal in cross-section.

7. A vibration-free handle according to claim 1, wherein the elastic member comprises rubber cushion which encloses the first rod.

8. A vibration-free handle according to claim 7, further including another elastic member for enclosing the second rod.

9. A vibration-free handle according to claim 8, wherein the first rod is polygonal in cross-section.

10. A vibration-free handle according to claim 7, wherein the first rod is polygonal in cross-section.

11. A vibration-free handle adapted to be mounted on a vibration source such as a vibrant tool vibrating in a reference direction via an elastic member, comprising:

a first element connected to the vibration source at one end thereof, the first element having an integral diagonal extension;

a second element mounted on the extension of the first element;

a first rod supported by the second element such that the first rod extends in a direction inclined relative to said direction;

a second rod connected to the first rod at one end thereof and having a predetermined inclination relative to the first rod;

a mass body mounted on the other end of the second rod; and an elastic member partially fitted in the second element and covering the first and second rods, said elastic member mounting the first rod on said second element and functioning to absorb vibrations from the vibration source.

12. A vibration-free handle according to claim 11, wherein the elastic member is provided between the first rod and the vibration source and possesses spring constants in three directions, one of said three directions being defined by the direction the vibration source vibrates and the other two of said three directions extending perpendicularly to each other in a plane perpendicular to said one direction.

13. A vibration-free handle according to claim 12, wherein the elastic member comprises a rubber cushion which is fitted around the first rod.

14. A vibration-free handle according to claim 11, wherein the elastic member comprises a rubber cushion which is fitted around the first rod.

15. A vibration-free handle according to claim 11, wherein the second rod extends perpendicularly relative to the direction the vibration source vibrates.

16. A vibration-free handle according to claim 15, wherein the elastic member comprises a rubber cushion which is fitted around the first rod.

* * * * *